US011318631B2

(12) United States Patent
Stapelbroek

(10) Patent No.: US 11,318,631 B2
(45) Date of Patent: May 3, 2022

(54) CUTTER ASSEMBLY FOR A HAIR CUTTING APPLIANCE

(71) Applicant: KONINKLIJKE PHILIPS N.V., Eindhoven (NL)

(72) Inventor: Martinus Bernardus Stapelbroek, Frieschepalen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 17/285,507

(22) PCT Filed: Nov. 27, 2019

(86) PCT No.: PCT/EP2019/082650
§ 371 (c)(1),
(2) Date: Apr. 15, 2021

(87) PCT Pub. No.: WO2020/114840
PCT Pub. Date: Jun. 11, 2020

(65) Prior Publication Data

US 2021/0379778 A1 Dec. 9, 2021

(30) Foreign Application Priority Data

Dec. 5, 2018 (EP) ..... 18210443

(51) Int. Cl.
*B26B 19/42* (2006.01)

(52) U.S. Cl.
CPC ..... *B26B 19/42* (2013.01)

(58) Field of Classification Search
CPC ..... B26B 19/42
USPC ..... 30/233
See application file for complete search history.

(56) References Cited

U.S. PATENT DOCUMENTS

| | | | |
|---|---|---|---|
| 3,088,205 | A | 5/1963 | Ellis |
| 4,044,463 | A | 8/1977 | Tietjens |
| 4,510,687 | A | 4/1985 | Groothuis |
| 5,980,452 | A | 11/1999 | Garenfeld |
| 7,065,877 | B2 | 6/2006 | Stevens |
| 2005/0198826 | A1 | 9/2005 | Segrea |

(Continued)

FOREIGN PATENT DOCUMENTS

| | | |
|---|---|---|
| DE | 102009031628 | 1/2011 |
| WO | 9529043 | 11/1995 |

(Continued)

OTHER PUBLICATIONS

International Search Report and Written Opinion dated Mar. 11, 2020 for International Application No. PCT/EP2019/082650 Filed Nov. 27, 2019.

*Primary Examiner* — Omar Flores Sanchez

(57) ABSTRACT

The present invention relates to a cutter assembly (10) for a hair cutting appliance (100). The cutter assembly comprises a cutting element (20), and a clamping element (30). The cutter assembly is configured to contact skin of a user of the hair cutting appliance. The clamping element is configured to clamp hair of the user that is growing out of the skin. The clamping element is configured to move within the cutter assembly to pull the clamped hair away from the skin of the user. The cutting element is configured to cut the clamped hair that has been pulled away from the skin of the user.

15 Claims, 2 Drawing Sheets

(56) References Cited

U.S. PATENT DOCUMENTS

2014/0358132 A1* 12/2014 Eckhouse ..... A45D 26/00
606/9

FOREIGN PATENT DOCUMENTS

WO 2008031495 5/2008
WO 2011001404 1/2011

* cited by examiner

CUTTER ASSEMBLY FOR A HAIR CUTTING APPLIANCE

CROSS REFERENCE TO RELATED APPLICATIONS

This application is the U.S. National Phase application under 35 U.S.C. § 371 of International Application No. PCT/EP2019/082650 filed Nov. 27, 2019, which claims the benefit of European Patent Application Number 18210443.0 filed Dec. 5, 2018. These applications are hereby incorporated by reference herein.

FIELD OF THE INVENTION

The present invention relates to cutter assembly for a hair cutting appliance, and a hair cutting appliance having such a cutter assembly.

BACKGROUND OF THE INVENTION

Shaving performance is affected by how close to the skin hair can be cut. Hair retraction is known to improve shaving performance, where a first blade cuts into the hair and raises the hair and a second blade then cuts through the hair—see for example U.S. Pat. No. 4,044,463A.

Further hair cutting systems employing hair retraction systems are known from e.g. U.S. Pat. Nos. 5,980,452A and 7,065,877B2.

Unfortunately, the efficiency of the retraction system according to U.S. Pat. No. 4,044,463A is very low, because in some cases the first blade cuts through the hair before it is cut by the second blade and in other cases the first blade does not lift the hair before it is cut by the second blade.

There is a need to address this issue.

SUMMARY OF THE INVENTION

It would be advantageous to have improved means for providing a close shave for a hair cutting appliance.

The object of the present invention is solved with the subject matter of the independent claims, wherein further embodiments are incorporated in the dependent claims. It should be noted that the following described aspects and examples of the invention apply also to the cutter assembly for a hair cutting appliance, and the hair cutting appliance having such a cutter assembly.

According to a first aspect, there is provided a cutter assembly for a hair cutting appliance, the cutter assembly comprising:

a cutting element; and a clamping element.

The cutter assembly is configured to contact skin of a user of the hair cutting appliance. The clamping element is configured to clamp hair of the user that is growing out of the skin. The clamping element is configured to move within the cutter assembly to pull the clamped hair away from the skin of the user. The cutting element is configured to cut the clamped hair that has been pulled away from the skin of the user.

In other words, hair grabbers that grab and pull hair are synchronized with a cutter that cuts the grabbed and pulled hair, and in this way a closer cut is provided.

Thus, hair can be pulled out of the skin by a distanced and then cut, which can provide for a longer lasting close shave feeling as hair can be cut in effect below the skin level and a cutting action can take place away from the skin surface providing for reduced skin irritation.

In this manner, a closer shave is provided that is suitable for linear, reciprocating hair cutting systems. By cutting the hair whilst clamped, and after it has been pulled in addition to a close shave, the hair can be cut at a very accurate retraction height. This provides for a smooth shave with hair cut to a uniform length with respect to the skin surface, and where the cut ends of the hair can be below the skin surface after being cut and once they have retracted back into the skin.

The clamping element of the cutter assembly is configured such that clamped hairs are moved in a direction substantially perpendicular to the skin of the user.

In an example, the cutter assembly is configured such that the cutting element can cut the clamped and pulled hair at a distance from the skin of the user.

In this way, skin irritation is reduced as the cutting action is undertaken above the skin surface.

In an example, the cutter assembly comprises a distance holder that is located below the cutting element, such that when the cutter assembly is in contact with the skin of the user, the distance holder is located between the cutting element and the skin of the user.

This ensures that cutting can take place at a set distance above the skin.

In an example, the distance holder comprises holes or slots configured to permit the entry of hair.

Thus, the holder can act as a counter to the cutting element, enabling a scissors type action to cut the hair, and where that counter can be stationary.

In an example, the cutting element is configured to cut the clamped hair after it has been pulled a set distance from the skin of the user.

In other words, hair is pulled out of the skin a predefined distance, and this is combined with synchronized cutting of the pulled hair whilst it is still clamped.

Thus, the clamping element can keep moving away from the skin surface for a distance further than the set distance, but will no longer be pulling the hair and potentially causing discomfort to the user, because the hair was cut when it had been pulled a predefined set distance.

In an example, the set distance is less than or equal to 0.65 mm.

In this way, a close shave is provided and at the same time comfort is provided because the hairs are pulled a distance less than that at which a pain threshold exists with respect to the pulling of hair.

In an example, the cutter assembly is configured such that the cutting element can cut the clamped and pulled hair at a distance from the skin of the user that is less than the set distance that the clamping element has pulled the hair.

In this manner, in effect hair is cut below the surface of the skin in that the part of the hair that was below the surface of the skin is pulled above the skin surface and is then cut. Then after cutting the hair attached to the body will move back into or retreat back into the skin with the cut end being below the surface of the skin.

Thus, when the cutter assembly touches the skin of the user, the cutter assembly can cut hair at a distance above the skin that is less that a distance that the hair is pulled.

In an example, the clamping element comprises a pair of clamps. The pair of clamps are configured to move closer together relative to each other to clamp one or more hairs.

In other words, the clamps are positioned either side of a hair, and clamp the hair from either side and then move away from the skin to pull the hair, which is cut to provide a close and comfortable shave.

Thus, one clamp can move toward the other to clamp the hair, or both clamps can move to clamp the hair.

To put this another way, at a hair entry slot, two clamping elements are present, which clamp hair and pull it upwards away from the skin, and whilst being clamped and pulled away from the skin the hair is cut, for example through arrival of a tooth of a reciprocating blade.

In an example, each clamp of the pair of clamps is configured to move to clamp the one or more hairs.

In an example, the clamping element comprises a plurality of pairs of clamps. Each pair of clamps of the plurality of clamps is configured to move closer relative to each other to clamp the hair. Thus, there are a numbers of pairs of clamps, and for each of the pair of clamps the two clamps move closer together, through either one or both moving, to clamp hair.

In an example, each pair of clamps of the plurality of claims comprises a first clamp and a second clamp. The plurality of first clamps is attached to a first moveable plate such that they are configured to move in unison as part of a hair clamping and pulling process.

In an example, the plurality of second clamps is attached to a second moveable plate such that they are configured to move in unison as part of the hair clamping and pulling process.

In this manner, the functionality of grabbing or clamping hair and then pulling that hair to enable a closer shave can be multiplied across a shaver or razor in an efficient manner.

In an example, the clamping element is configured to release the cut hair.

In an example, the clamping element is configured to move within the cutting element to a start position after the clamped hair has been cut.

According to a second aspect, there is provided a hair cutting appliance having a cutter assembly according to the first aspect.

Advantageously, the benefits provided by any of the above aspects equally apply to all of the other aspects and vice versa.

The above aspects and examples will become apparent from and be elucidated with reference to the embodiments described hereinafter.

BRIEF DESCRIPTION OF THE DRAWINGS

Exemplary embodiments will be described in the following with reference to the following drawings.

DETAILED DESCRIPTION OF THE EMBODIMENTS

Figure 1:
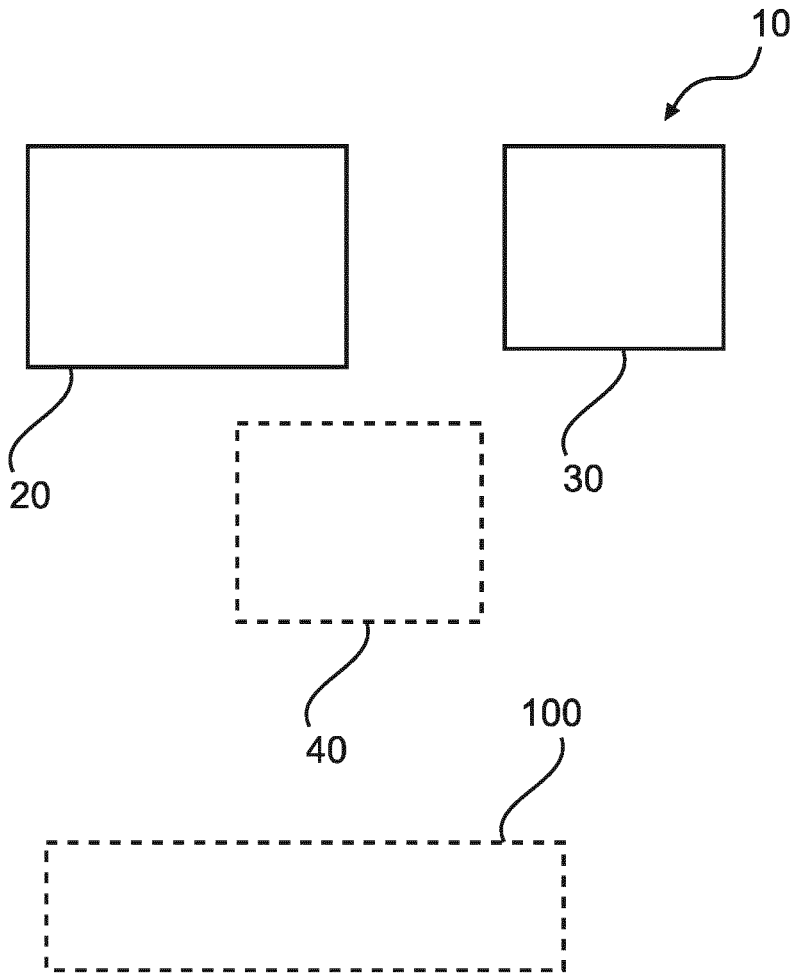
FIG. 1 shows a schematic set up of an example of a cutter assembly for a hair cutting appliance with a schematic set up of an example of a hair cutting appliance also being shown.

FIG. 1 shows an example of a cutter assembly 10 for a hair cutting appliance 100. The cutter assembly comprises a cutting element 20, and a clamping element 30. The cutter assembly is configured to contact skin of a user of the hair cutting appliance. The clamping element is configured to clamp hair of the user that is growing out of the skin. The clamping element is configured also to move within the cutter assembly to pull the clamped hair away from the skin of the user. The cutting element is configured to cut the clamped hair that has been pulled away from the skin of the user.

According to an example, the cutter assembly is configured such that the cutting element can cut the clamped and pulled hair at a distance from the skin of the user.

According to an example, the cutter assembly comprises a distance holder 40 that is located below the cutting element. This means that when the cutter assembly is in contact with the skin of the user, the distance holder is located between the cutting element and the skin of the user.

In an example, the distance holder is a guard or stationary blade or foil.

In an example, the cutting element is immediately adjacent to the distance holder.

In an example, the distance holder is configured to act as a counter to the cutting element, thus providing a scissors type action for the cutting of the hair by the cutting element.

In an example, the distance holder is configured to be stationary with respect to a moveable cutting element.

Thus, the distance holder can have at least two functions: creating the right distance between the cutting element (moving part) and the skin; and creating a stationary counter cutting edge for the moving cutting element to cut the hair against.

According to an example, the distance holder comprises holes or slots configured to permit the entry of hair.

According to an example, the cutting element is configured to cut the clamped hair after it has been pulled a set distance from the skin of the user.

According to an example, the set distance is less than or equal to 0.65 mm.

In an example, the set distance is equal to 0.6 mm.

In an example, the set distance is equal to 0.55 mm.

In an example, the set distance is equal to 0.5 mm.

In an example, the set distance is equal to 0.45 mm.

In an example, the set distance is equal to 0.4 mm.

The set distance can be set to other required distances if necessary.

According to an example, the cutter assembly is configured such that the cutting element can cut the clamped and pulled hair at a distance from the skin of the user that is less than the set distance that the clamping element has pulled the hair.

In an example, a distance holder of the cutter assembly positioned between the cutting element and the skin of the user can have a size that means that when the cutter assembly touches the skin of the user, the cutting element cuts the hair at a distance above the skin that is less than the distance the hair is pulled.

According to an example, the clamping element 30 comprises a pair of clamps 32, 34. The pair of clamps is configured to move closer together relative to each other to clamp one or more hairs.

According to an example, each clamp of the pair of clamps is configured to move to clamp the one or more hairs.

In an example, the clamps move simultaneously towards each other.

According to an example, the clamping element comprises a plurality of pairs of clamps 32, 34. Each pair of clamps of the plurality of clamps is configured to move closer relative to each other to clamp the hair.

According to an example, each pair of clamps of the plurality of claims comprises a first clamp 32 and a second clamp 34. The plurality of first clamps is attached to a first moveable plate 50 such that they are configured to move in unison as part of a hair clamping and pulling process.

According to an example, the plurality of second clamps is attached to a second moveable plate 60 such that they are configured to move in unison as part of the hair clamping and pulling process.

According to an example, the clamping element is configured to release the cut hair.

According to an example, the clamping element is configured to move within the cutting element to a start position after the clamped hair has been cut.

Figure 2:
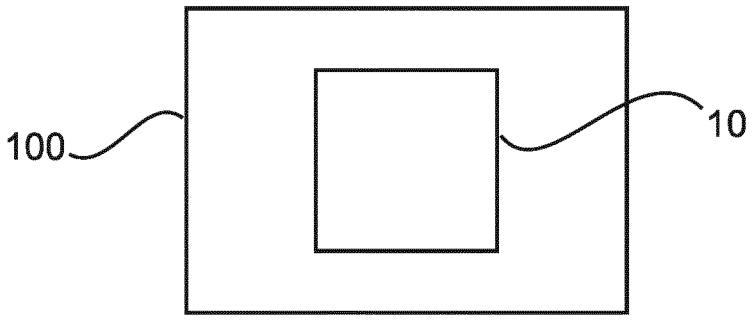
FIG. 2 shows a schematic set up of an example of a hair cutting appliance having a cutter assembly.

FIG. 2 shows an example of a hair cutting appliance 100 having a cutter assembly 10 as described above with respect to FIG. 1.

Figure 3:
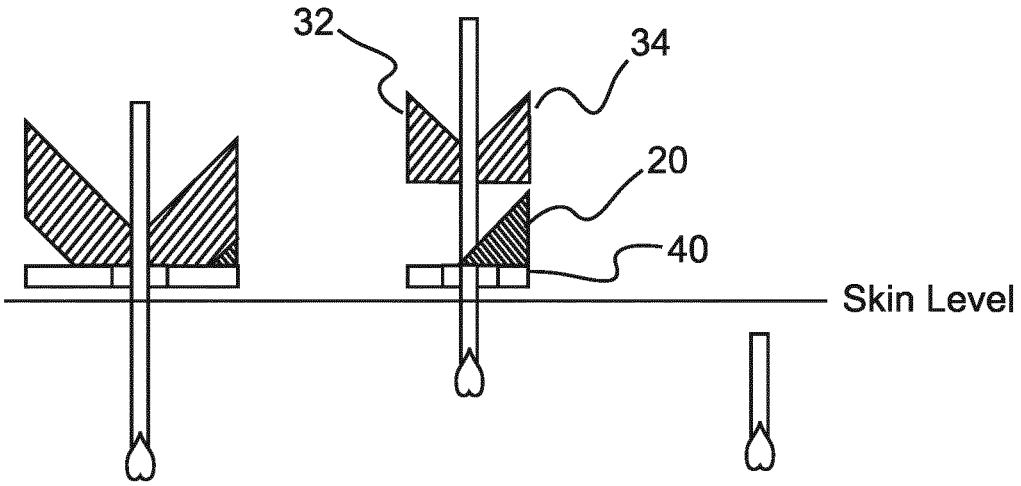
FIG. 3 shows the operation of an example of a cutter assembly.
Figure 4:
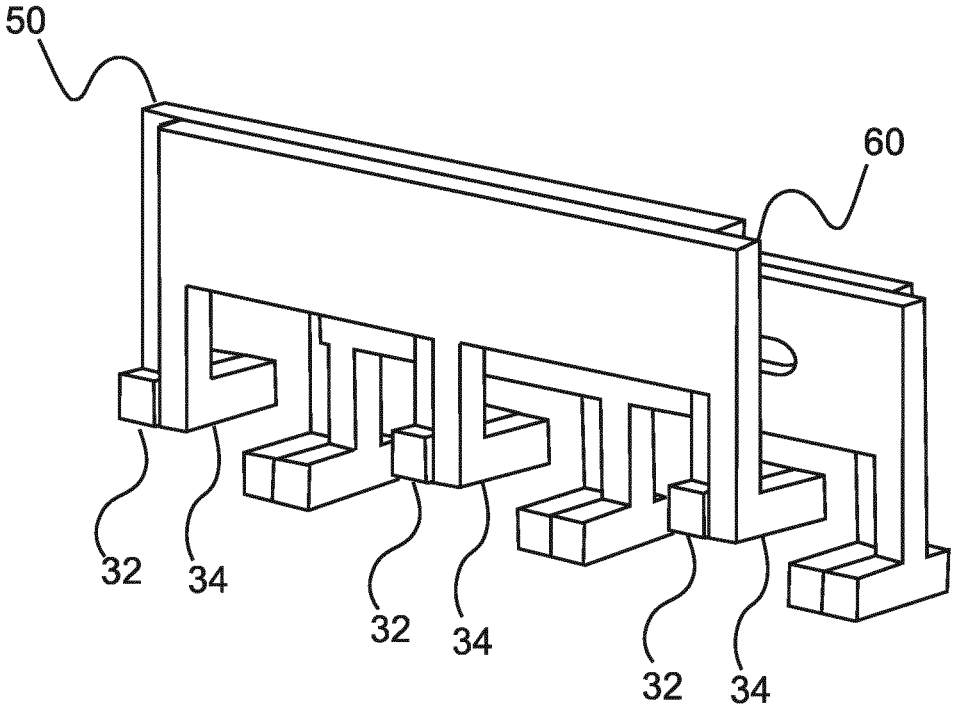
FIG. 4 shows an example of a cutter assembly.

The cutter assembly for a hair cutting appliance and the hair cutting appliance with such a cutter assembly are now additionally described in conjunction with specific detailed embodiments shown in FIGS. 3-4.

FIG. 3 shows pictorially operation of a detailed example of the cutter assembly. This example of the cutter assembly has a cutting element 20, and a clamping element in the form of two clamps 32 and 34. The cutting element also has a distance holder 40. A user's skin is shown, out of which is growing a hair. The cutter assembly has the cutting element situated directly above the distance holder and when the hair cutting appliance is applied to the user's skin for shaving purposes, the distance holder contacts the skin or is just above the skin. The distance holder has a slot, as shown, into which the hair is located as shown as part of the shaving process. As shown in the left most picture, the two clamps, that started in an open position, have clamped a hair. As shown in the middle picture, the two clamps whilst clamping the hair move upwards, thereby pulling the hair a certain distance out of the skin. The cutting element then cuts the hair whilst it is clamped, and does so at a distance from the skin that is less than the distance the hair has been pulled. This means that after cutting, the hair retreats back into the skin and the cut end of the hair is now situated below the surface of the skin, as shown in the picture on the right. Not shown in FIG. 3 is the clamping opening to release the cut hair, then moving downwards back to a start position with the two clamps 32 and 34 separated from each other, ready to move toward each other and clamp another hair and repeat the above process.

FIG. 4 shows a detailed example of how hair clamping and pulling process can be scaled up. A first moveable plate 50 has a number of first clamps 32 attached to it. A second moveable plate 60 has a number of second clamps 34 attached to it. The two moveable plates 50 and 60 can move sideways with respect to each other in order that a gap is formed between each clamp 32 and each clamp 34. The two plates 50 and 60 can then move in the opposite direction to close the gap between the clamps 32 and 34 to clamp hair. Then both moveable plates 50 and 60 move upwards together, whilst clamping hair to pull the hair out of the skin slightly, and a cutting element then cuts the hair. Thus, the process as described with respect to FIG. 3 now operates in a scaled up version with clamps 32 and 34 moving in unison.

It has to be noted that embodiments of the invention are described with reference to different subject matters. In particular, some embodiments are described with reference to method type claims whereas other embodiments are described with reference to the device type claims. However, a person skilled in the art will gather from the above and the following description that, unless otherwise notified, in addition to any combination of features belonging to one type of subject matter also any combination between features relating to different subject matters is considered to be disclosed with this application. However, all features can be combined providing synergetic effects that are more than the simple summation of the features.

While the invention has been illustrated and described in detail in the drawings and foregoing description, such illustration and description are to be considered illustrative or exemplary and not restrictive. The invention is not limited to the disclosed embodiments. Other variations to the disclosed embodiments can be understood and effected by those skilled in the art in practicing a claimed invention, from a study of the drawings, the disclosure, and the dependent claims.

In the claims, the word "comprising" does not exclude other elements or steps, and the indefinite article "a" or "an" does not exclude a plurality. A single processor or other unit may fulfill the functions of several items re-cited in the claims. The mere fact that certain measures are re-cited in mutually different dependent claims does not indicate that a combination of these measures cannot be used to advantage. Any reference signs in the claims should not be construed as limiting the scope.

The invention claimed is:

1. A cutter assembly for a hair cutting appliance, the cutter assembly comprising:

a cutting element; and a clamping element;

wherein, the cutter assembly is configured to contact skin of a user of the hair cutting appliance;

wherein, the clamping element is configured to clamp hair of the user that is growing out of the skin;

wherein, the clamping element is configured to move within the cutter assembly to pull the clamped hair away from the skin of the user;

wherein, the cutting element is configured to cut the clamped hair that has been pulled away from the skin of the user; and wherein the clamping element is configured to move in a direction substantially perpendicular to and away from the skin of the user.

2. The cutter assembly according to claim 1, wherein the cutter assembly is configured such that the cutting element can cut the clamped and pulled hair at a distance from the skin of the user.

3. The cutter assembly according to claim 1, wherein the cutter assembly comprises a distance holder that is located below the cutting element, such that when the cutter assembly is in contact with the skin of the user, the distance holder is located between the cutting element and the skin of the user.

4. The cutter assembly according to claim 3, wherein the distance holder comprises holes or slots configured to permit the entry of hair.

5. The cutter assembly according to claim 1, wherein the cutting element is configured to cut the clamped hair after it has been pulled a set distance from the skin of the user.

6. The cutter assembly according to claim 5, wherein the set distance is less than or equal to 0.65 mm.

7. The cutter assembly according to claim 5, wherein the cutter assembly is configured such that the cutting element can cut the clamped and pulled hair at a distance from the skin of the user that is less than the set distance that the clamping element has pulled the hair.

8. The cutter assembly according to claim 1, wherein the clamping element comprises a pair of clamps; and wherein the pair of clamps is configured to move closer together relative to each other to clamp one or more hairs.

9. The cutter assembly according to claim 8, wherein each clamp of the pair of clamps is configured to move to clamp the one or more hairs.

10. The cutter assembly according to claim 9, wherein each clamp of the pair of clamps is configured to move in a direction opposite to the other clamp in order to clamp the one or more hairs between them.

11. The cutter assembly according to claim 8, wherein the clamping element comprises a plurality of pairs of clamps; and wherein each pair of clamps of the plurality of clamps is configured to move closer relative to each other to clamp the hair.

12. The cutter assembly according to claim 11, wherein each pair of clamps of the plurality of clamps comprises a first clamp and a second clamp, and wherein the plurality of first clamps is attached to a first moveable plate such that they are configured to move in unison as part of a hair clamping and pulling process.

13. The cutter assembly according to claim 12, wherein the plurality of second clamps is attached to a second moveable plate such that they are configured to move in unison as part of the hair clamping and pulling process.

14. A hair cutting appliance having a cutter assembly according to claim 1.

15. The cutter assembly according to claim 1, wherein the clamping element is configured to move the clamped hair in a direction substantially perpendicular to the skin of the user.

* * * * *